United States Patent [19]

Piercy

[11] 4,026,519

[45] May 31, 1977

[54] BUILDING PANEL PLACEMENT APPARATUS

[75] Inventor: Harry W. Piercy, Chico, Calif.

[73] Assignee: The Raymond Lee Organization, Inc., New York, N.Y. ; a part interest

[22] Filed: Mar. 8, 1976

[21] Appl. No.: 665,029

Related U.S. Application Data

[63] Continuation-in-part of Ser. No. 543,818, Jan. 24, 1975, abandoned.

[52] U.S. Cl. ..... 254/2 R; 182/2

[51] Int. Cl.[2] ..... B60P 1/00

[58] Field of Search ..... 254/2 R, 2 B, 2 C, 4 R, 254/4 B, 4 C, 8 R, 8 B, 8 C, 9 R, 9 B, 9 C, 10 R, 10 B, 10 C, 127, 124; 214/1 D, 1 SW, 1 MS, 1 CM; 182/2

[56] References Cited

UNITED STATES PATENTS

| | | | |
|---|---|---|---|
| 1,141,928 | 6/1915 | Brown | 254/8 C |
| 1,725,329 | 8/1929 | Blandford | 214/1 SW |
| 2,465,206 | 3/1949 | Davis | 214/1 SW |
| 2,616,768 | 11/1952 | Stemm | 182/2 |
| 2,713,520 | 7/1955 | Greene | 254/9 C |
| 2,806,613 | 9/1957 | Johnson | 254/8 B |
| 2,903,896 | 9/1959 | Greene | 254/4 C |
| 2,974,929 | 3/1961 | Day | 254/4 C |
| 3,131,928 | 6/1964 | Whipple | 214/1 SW |
| 3,382,988 | 5/1968 | O'Reilly | 214/1 SW |
| 3,467,261 | 9/1969 | Jewell | 214/1 SW |

*Primary Examiner*—Al Lawrence Smith
*Assistant Examiner*—Robert C. Watson
*Attorney, Agent, or Firm*—Howard I. Podell

[57] ABSTRACT

A machine for use in placing of a wall or ceiling panel in position which holds the panel firmly in place as it is nailed into the structure of a building. The machine is mounted on wheeled base and fitted with a support platform mounted by compression springs to fixed arms. The fixed arms are oriented perpendicular to the plane of the support platform, and are pivotably mounted to an extendable arm linkage joined to the base. The extendable arm linkage consists of a plurality of pivotable arms, rotatably linked by a first set of chain drives driven by a first gear motor for rotation of the arms of the linkage to extend or withdraw the platform in relation to the base, and a second set of chain drives driven by a second gear motor which serves to rotate the plane of the support platform with respect to the base plane.

6 Claims, 6 Drawing Figures

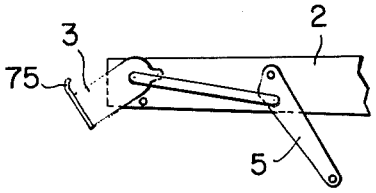
FIG. 3
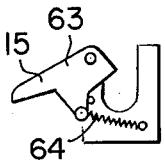
FIG. 4
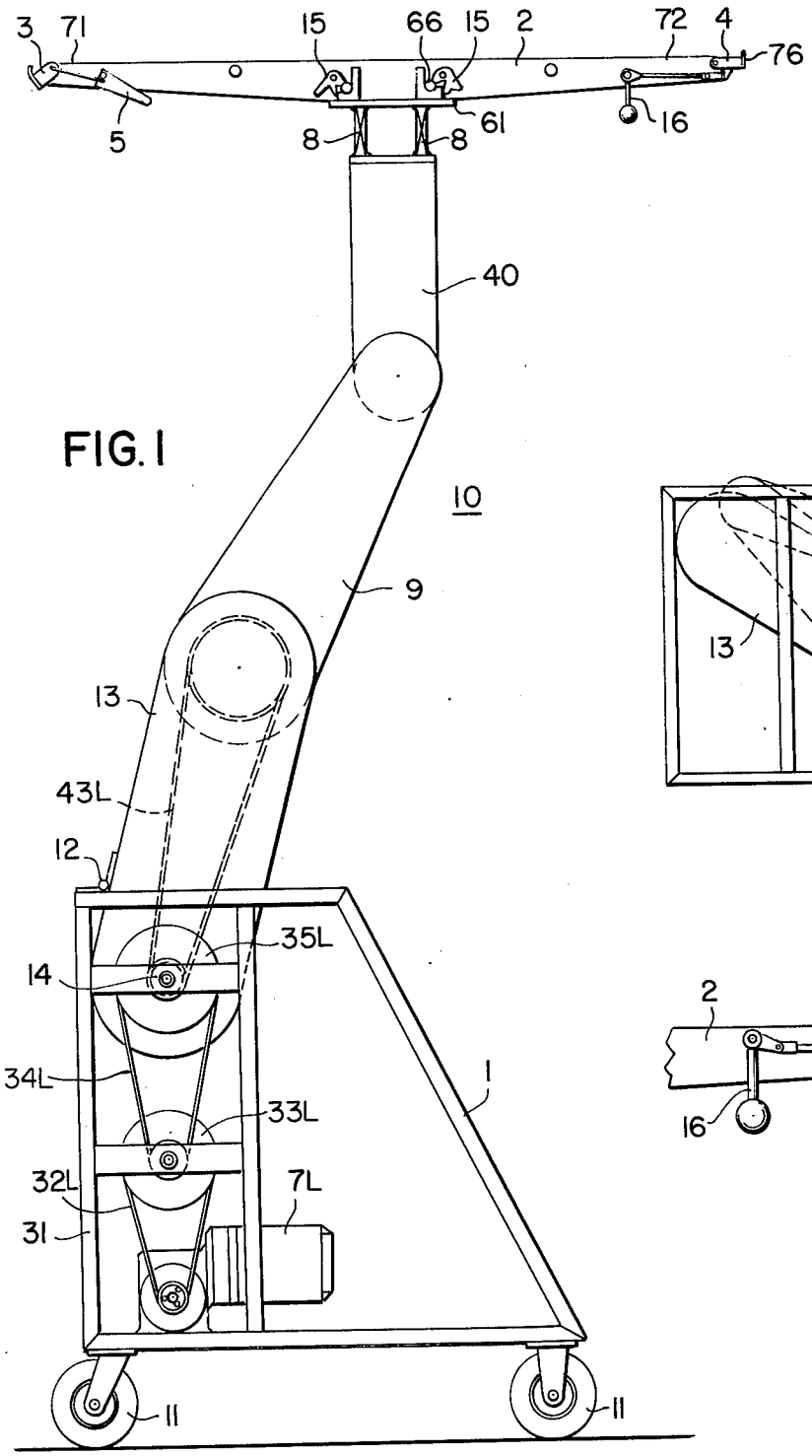
FIG. 1
FIG. 2
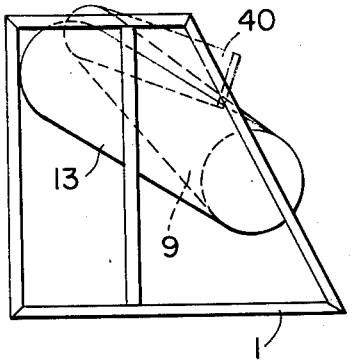
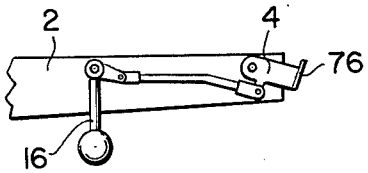
FIG. 5

BUILDING PANEL PLACEMENT APPARATUS

SUMMARY OF THE INVENTION

This application is a continuation-in-part of co-pending application Ser. No. 543,818 filed Jan. 24, 1975 by the same inventor, which co-pending application is abandoned.

My invention is a machine for use in placing of a wall or ceiling panel in position which holds the panel firmly in place as it is nailed into the structure of a building.

The machine is mounted on wheeled base and fitted with a support platform mounted by compression springs to fixed arms.

The fixed arms are oriented perpendicular to the plane of the support platform, and are pivotably mounted to an extendable arm linkage joined to the base.

The extendable arm linkage consists of a plurality of pivotable arms, rotatably linked by a first set of chain drives driven by a first gear motor for rotation of the arms of the linkage to extend or withdraw the platform in relation to the base, and a second set of chain drives driven by a second gear motor which serves to rotate the plane of the support platform with respect to the base plane.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a side view of the invention;

FIG. 2 is a side view of the invention in the stored position, with the platform removed;

FIG. 3 is a fragmentary side view of a first end of the platform;

FIG. 4 is a side view of a platform latch;

FIG. 5 is a fragmentary side view of a second end of the platform; and

DESCRIPTION OF THE PREFERRED EMBODIMENT

Figure 6:
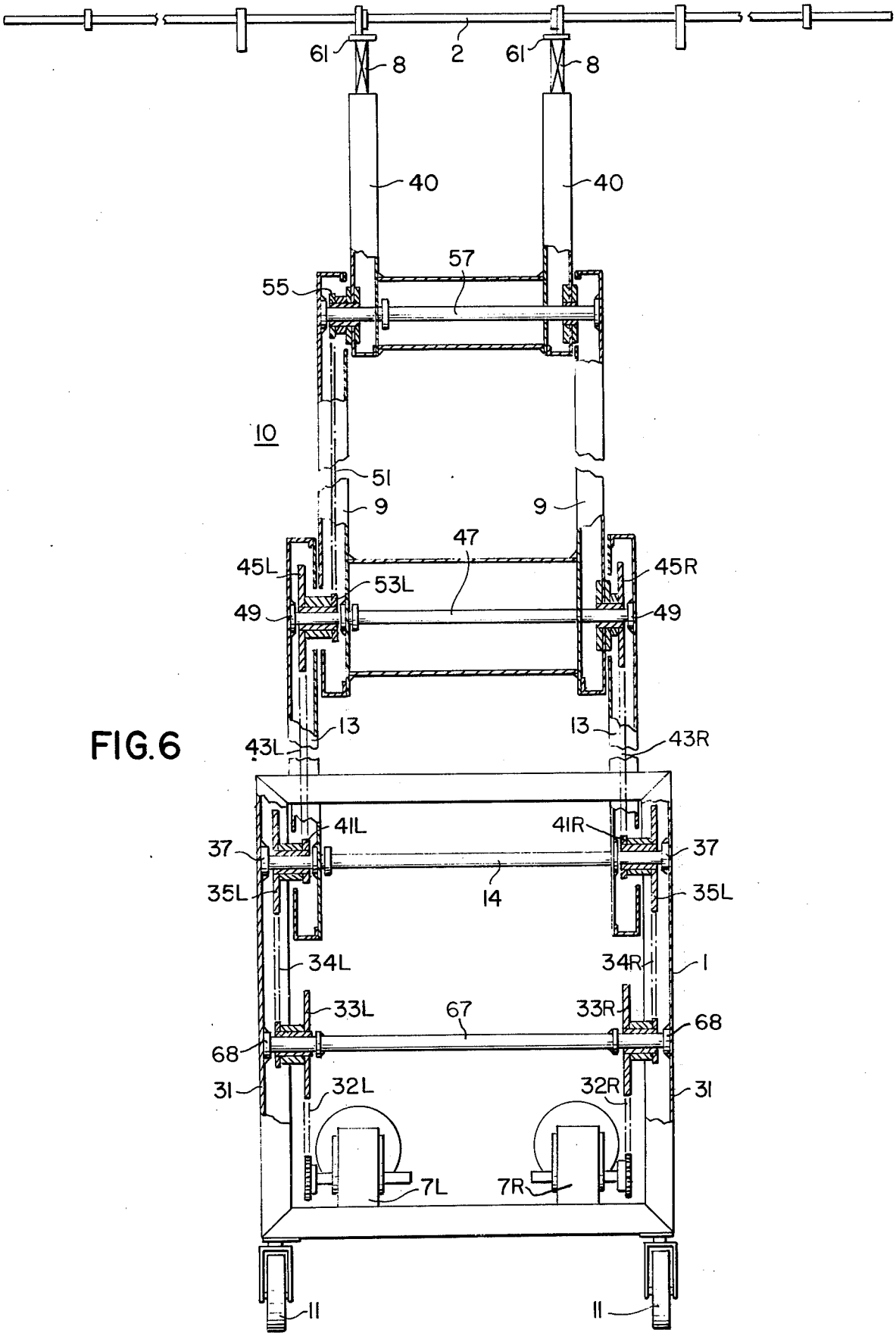
FIG. 6 is a sectional view in elevation of the invention.

Turning now descriptively to the drawings, in which similar reference characters denote similar elements throughout the several views, FIGS. 1–6 illustrate the building panel placement apparatus 10. A platform 2 is mounted by compression springs to two support arms 40 which are each pivotably mounted to a pair of support arms 9 each pivotably mounted to a pair of support arms 13 that are in turn pivotably mounted to the base 1 of the apparatus.

The base 1 is formed of an open framework 31 fitted on caster wheels 11 and contains a pair of gear motors 7L and 7R which are individually controlled, with motor 7L linked by a first set of sprockets and chain drive to rotate support arms 40 and platform 2 with respect to the plane on which the base 11 rests, while motor 7R is linked by a second set of sprockets and chain drives to extend or retract the support arms 9 and 13 by rotating them relative to ach other and to the base 1.

In the accompanying description, the first set of linkages joined to motor 7L will be shown as mounted in the base including the left member of each pair of arms 13 and 9 while the second set of linkages joined to motor 7R will be shown as mounted in the base including the right member of the pair of arms 13 and 9. The term "rotatably mounted" with respect to a sprocket and axle denotes that the sprocket rotates freely with respect to the attached axle. The term "fixed" with respect to a sprocket and axle denotes that the sprocket and attached axle cannot rotate relative to each other.

Motor 7R is linked by a chain drive 32R to an idler sprocket 33R rotatably mounted about axle 67, with axle 67 rotatably mounted in bearings 68 to the framework 31. Sprocket 33R is linked by a chain drive 34R to a sprocket 35R fixed about an axle 14 which axle 14 is rotatably mounted in bearings 37 to the framework 31 and axle 14 is fixed to each support arm 13 so that rotation of axle 14 rotates parallel arms 13 relative to base 1.

Sprocket 35R is fixed to a concentric sprocket 41R which is linked by a chain drive 43R to a sprocket 45R fixed to an axle 47, with axle 47 rotatably mounted in bearings 49 at the outer ends of parallel arms 13. Axle 47 is fixed to ach of the two parallel arms 9 so that rotation of axle 47 rotates parallel arms 9 relative to parallel arms 13.

Thus individual rotation of gear motor 7R acts to rotate parallel arms 9 with respect to parallel arms 13, and parallel arms 13 with respect to base 1 so as to either extend parallel arms 13 away from base 1, as shown in FIGS. 1 and 6, or to fold arms 9, 13 into the open base framework 1, as shown in FIG. 2, depending on the direction of rotation gear motors 7R.

Platform 2 and support arms 40 may be rotated about axle 57, as described hereinafter by rotation of motor 7L so that platform 2 lies in the horizontal or the vertical plane at the fully extended or retracted position of the support arm linkage, or at a suitable intermediate position of the linkage of the support arms.

Motor 7L is linked by a chain drive 32L to a sprocket 33L rotatably mounted about axle 67, which axle 67 is rotatably mounted by bearing 68 to the framework 31. Sprocket 33L is linked by a chain drive 34L to an idler sprocket 35L, rotatably mouned about axle 14.

Sprocket 35L is fiexed to a sprocket 41L which is linked by a chain drive 43L to an idler sprocket 45L rotatably mounted about axle 47 which is rotatably mounted in bearings 49 at the outer ends of parallel arms 13. Axle 47 is fixed to the two parallel arms 9 so that rotation of axle 47 rotates parallel arms 9 relative to parallel arms 13.

Idler sprocket 45L is fixed to an idler sprocket 53 that is linked by a chain drive 51L to a sprocket 55 fixed on axle 57. Axle 57 is rotatably mounted in bearings 58 at the outer ends of parallel arms 9, with shaft 57 fixed to each of the two parallel support arms 40.

Thus individual rotation of gear motors 7L acts to rotate parallel arms 40 with respect to parallel arms 9 about the axis of axle 57 regardless of the relative positions of arms 9 and 13 so that platform 2 and supporting arm 40 may be set with platform 2 resting in the horizontal or the vertical plane at the fully extended position of the support arm linkage, at a suitable intermediate position of the linkage of the support arms, as shown in FIG. 1, or in the folded configuration, as shown in FIG. 2.

Platform 2 is mounted to a support member 61, to which it is detachably fastened by latchs 15, with support member 61 fixed to the compression springs 8, each spring 8 being fitted to the extended end of a support arm 40. Each latch 15 is formed with a rotatable catch lever 63, held by a spring 64 so as to grip a detent 66 fitted on the platform 2, as shown in FIGS. 1 and 4.

At opposed ends 71 and 72 of platform 2, rotatable edge clamp 3 and rotatable edge stop 4 are respectively mounted to platform 2, with clamp 3 and stop 4 each pivotably linked to a rotatable lever 5 and 16 respectively so that clamp 3 and stop 4 may be rotated individually into position to project above the outer surface of platform 2 to maintain a wall or ceiling panel (not shown) in aligned position on platform 2. Clamp 3 is shaped with a bent projection 75 so as to clamp panel to the platform, with stop 4 formed with a projection 76 that is perpendicular to the resting surface of platform 2 in the extended position. In the retracted positions, clamp 3 and stop 4 may be rotated to below the level of the exterior resting surface of platform 2.

In use, platform 2 may be extended and rotated with a building panel lying on the exterior resting surface and held in place by stops 4 and clamps 3 until the panel is pressed against the wall or ceiling surface to which the panel is to be nailed. Compression springs 8 enable the operator of the machine to uniformly force the panel against the wall or ceiling mounts to which it is to be nailed, and to hold the panel while the panel is permanently fastened.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. Apparatus for supporting a building panel in place against a horizontal ceiling or vertical wall support comprising, a base unit jointed to, a pivotable linkage of support members joined to a platform, said support members comprising three pairs of spaced parallel arm members, with said base unit pivotably mounted to a first pair of said parallel arm members, at the lower extremity of each said arm member, said platform mounted in non-rotatable engagement to second pair of said parallel arm members at the upper extremity of each of said arm members, with a third pair of said arm members pivotably linking the said first pair of arm members to the said second pair of arm members, in which the upper extremity of each of the first pair of arm members is pivotably linked to the lower extremity of each of the third pair of arm members, and the upper extremity of each of the third pair of arm members is pivotably linked to the lower extremity of the second pair of arm members, with a first motorized means mounted in the base unit, said first motorized means joined to first drive means for simultaneously rotating the first pair of arm members with respect to both the said base unit and with respect to the said pair of third arm members, and a second motorized means mounted in the base unit, said second motorized means joined to second drive means for rotating the said second pair of arm member with respect to the said third pair of arm members, such that said second motor means may rotate the platform, attached to the said second pair of arm members, with respect to the base unit, independently of the positions of the first and third pair of arm members.

2. The combination as recited in claim 1 in which each of the arm members of the first pair of arm members is of hollow construction, with each of the said arm members enclosing a chain drive, and with a first chain drive in one of the arm members linked to the first motorized means in the base unit and with a second chain drive in the other of the arm members linked to the second motorized means in the base unit, with each of the arm members of the third pair of arm members being of hollow construction, with each of the said arm members enclosine a chain drive, and with a first chain drive in one of the arm members linked to the first chain drive of the first pair of arm members, and with the second chain drive in the other of said arm members linked to the second chain drive of the first pair of arm members, with one of the arm members of the second pair of arm members being of hollow construction and enclosing a chain drive linked to the second chain drive of the third pair of arm members, with said first chain drives mounted to first means to rotate the linkage of the first pair of arm members to the base unit and to second means to rotate the linkage of the first pair of arm members to the third pair of arm members, with said second chain drive mounted to third means to rotate the linkage of the second pair of arm members to the third pair of arm members.

3. The combination as recited in claim 1, in which the arm members may be rotated so as to fold within the base unit, in the retracted position.

4. The combination as recited in claim 1 in which the platform is fitted on a first end with a rotatable bar which in a first position may be manually rotated to project above the surface of the platform and in a second position manually rotated to lie flush with or below the surface of the platform about the platform end.

5. The combination as recited in claim 4 in which the platform is fitted on a second end with a rotatable bar which, in the first position, may be manually rotated to project above the surface of the platform and to clamp a sheet of material to the platform, and rotated to a second position, flush with or below the surface of the platform, about the platform end.

6. The combination as recited in claim 1 in which the platform is mounted to each of the second parallel pair of arm members by compression spring means.

* * * * *